US010791770B2

(12) United States Patent
Hawkins

(10) Patent No.: US 10,791,770 B2
(45) Date of Patent: Oct. 6, 2020

(54) ULTIMATE SLIP

(71) Applicant: Wynter Shynet Hawkins, Norfolk, VA (US)

(72) Inventor: Wynter Shynet Hawkins, Norfolk, VA (US)

( * ) Notice: Subject to any disclaimer, the term of this patent is extended or adjusted under 35 U.S.C. 154(b) by 30 days.

(21) Appl. No.: 15/846,184

(22) Filed: Dec. 18, 2017

(65) Prior Publication Data

US 2018/0177243 A1 Jun. 28, 2018

Related U.S. Application Data

(60) Provisional application No. 62/498,310, filed on Dec. 22, 2016.

(51) Int. Cl.

| | |
|---|---|
| ***A41B 9/08*** | (2006.01) |
| ***A41D 15/00*** | (2006.01) |
| ***A41B 9/16*** | (2006.01) |
| *A41B 9/06* | (2006.01) |
| *A41D 1/22* | (2018.01) |

(52) U.S. Cl.

CPC ..... *A41B 9/08* (2013.01); *A41B 9/16* (2013.01); *A41D 15/002* (2013.01); *A41B 9/06* (2013.01); *A41D 1/22* (2013.01)

(58) Field of Classification Search

CPC ..... A41B 9/08; A41B 9/16; A41B 15/002; A41B 9/06; A41B 1/22; A41D 15/002; A41D 1/22

See application file for complete search history.

(56) References Cited

U.S. PATENT DOCUMENTS

| | | | | |
|---|---|---|---|---|
| 2,899,962 | A * | 8/1959 | Entringer et al. | A41B 9/08 450/95 |
| 5,628,064 | A * | 5/1997 | Chung | A41D 15/00 2/119 |
| 6,205,585 | B1 * | 3/2001 | Capparelli | A41B 9/06 2/106 |
| 6,338,161 | B1 * | 1/2002 | Ali Muhammad | A41B 9/08 2/69 |
| 7,318,240 | B1 * | 1/2008 | Rendone | A41B 9/08 2/69 |
| 8,096,851 | B2 * | 1/2012 | Fine | A41D 1/22 2/104 |
| 8,221,186 | B2 * | 7/2012 | Policaro | A41C 3/08 2/104 |
| 8,808,056 | B2 * | 8/2014 | Murphy | A41C 3/08 450/1 |
| 9,364,035 | B1 * | 6/2016 | Shachaf | A41D 15/00 |
| 10,154,698 | B2 * | 12/2018 | Loveland | A41B 9/10 |
| 2016/0021950 | A1 * | 1/2016 | Rafieiankopaei | A41D 15/00 2/243.1 |
| 2018/0168251 | A1 * | 6/2018 | Loveland | A41B 9/10 |

* cited by examiner

*Primary Examiner* — Christopher R Harmon

(57) ABSTRACT

This Invention relates to a new and novel customizable women's undergarment or slip, consisting of multiple pieces; a top portion with straps and a lace cleavage cover, a middle slip and a bottom slip. The present invention can be adjusted in various ways, the parts can extend from a top portion with straps detachably connected to a short length half slip and further detachably connected to a long length half slip, when combined these results in a longer full length slip. The top portion can be worn separately as a camisole with or without straps, the middle piece detaches as a short half slip and the bottom piece detaches as a long half slip.

1 Claim, 7 Drawing Sheets

ULTIMATE SLIP

PRIOR ART

U.S. Pat. No. 1,784,369 Dec. 9, 1930 R. Lowenbaum
U.S. Pat. No. 3,327,714 Jun. 27, 1967 D. Steinberger
U.S. Pat. No. 2,899,962 Aug. 18, 1959 M. And S. Entringer
U.S. Pat. No. 8,808,056 Aug. 19, 2014 J. And J. Murphy
U.S. Pat. No. 4,377,007 Mar. 22, 1983 M. Sudjian
U.S. Pat. No. 2,193,605 Mar. 12, 1940 H. Nielsen Thor
U.S. Pat. No. 2,831,194 Apr. 22, 1958 E. Hunczak
U.S. Pat. No. 931,151 Aug. 17, 1909 R. M. Sydey
U.S. Pat. No. 2,227,214 Dec. 31, 1940 N. Bisberg
Pub No. US2016/0157538 Jun. 9, 2016

BACKGROUND OF THE INVENTION

Women's undergarment and slips have been around for decades and have seen some improvement over the years. However, problems surface in that most full length slips are made as one whole piece which can only be adjusted at the shoulders and can only be worn one way. The shoulders adjustment still may not allow for the proper fit, this can cause the slip to be uncomfortable. Current full length slips may be too long for some skirts and dresses which may cause user to tighten the straps.

However, this can pull the breast portion of the slip to far up above breast area which in turn can make cleavage area look bulky due to an improper fit. Slips can also be too short which does not provide coverage for the entire garment and can allow longer skirts or dresses to cling or become staticky at the bottom portion of the garment.

Also, the problems with half slips are that they cannot be adjusted. Half slips elastic can become lose and can fall from the waist. Additionally, when the half slip is to long for the dress or skirt it can be seen by others, this can cause the clothing to look sloppy and the user to become embarrassed.

Moreover, most current full length slips can only be taken off and put on underneath the garment when all clothing is removed. And most current slips only come in one color or black and white, there are no current slips that allow for multicolored slip that can be switched, adjusted or interchanged to different colors as desired without attachment to other parts of the garment.

Therefore, there is still a need for a women's undergarment or slip to fill the needs of the modern women. A slip that detachably connects to fits any dress length, style and size, that conform to user body and can be customized or adjusted to provide a comfortable fit.

A slip that allows the user to look their best in every style of dress. And that allow user to switch or change the colors as desired to a multiple color slip with interchangeable colors that can be worn individually and separate of the other portion.

SUMMARY OF THE DISCLOSURE

In view of the fore mentioned problems with women's undergarments or slips. The present invention is an innovative new women's undergarment or slip that provides the perfect fit and addresses the problems of current slip designs. One of the ways the present invention addresses the problems is by allowing each piece of the slip to be customized and separated by a detachably connect feature, with zones and/or slots. This new invention with the detachably connect feature will allow user to adjust and customize this slip to meet their specifications and to determine the slip's length as desired to conform to the dress length, style and size. Each part of the present invention can attach and detach from each other piece; the top portion or camisole, the short half slip and the long half slip. This allows each piece to be individually worn without the other pieces tighten and secured by a rope, cord or string tied or fastened, however certain embodiments of the present invention include, but are not limited to these methods.

The present invention will have two straps that are located above the top portion/camisole and connected by the detachably connect feature and slots. The slots are vertical in multiple sections on the straps. The straps can adjust to be shorten, lengthen or removed as desired. The straps can be removed for strapless dresses, crisscrossed, worn on one side or customized as desired.

The present invention design features a lace cleavage cover, this feature of the present invention is detachably connected to the front portion of the top portion/camisole. The lace cleavage cover can be permanently attached and made within the top portion/camisole. However the present invention top portion/camisole section may or may not come with a lace cleavage cover. The lace cleavage cover has an accordion fold this is achieved as the lace slides up and down on a rope, cord or line and connected by notches at different locations on the rope to allow the stretchable lace to expand to cover cleavage or shrink when not in use. The accordion fold will allow the lace cleavage cover to lay flat to ensure that the lace cleavage cover will not have a bulky appearance when lowered.

As stated the top portion/camisole part of the slip can be worn with the straps as an individual piece or as a separate piece that is strapless. When the top portion/camisole is worn with the straps, the straps themselves will provide a secure and comfortable fit for the user. When worn strapless, the top portion/camisole piece can stay on the upper part of the women's body securely by a rope, cord or string with elastic and can be tied to desired tightness but are not limited to these methods. The top portion/camisole have attachment/detachment slots which will allow the middle/short or bottom/long portion to connect by buttons, snaps, velcro or other means that accomplish the same or similar results. When top portion/camisole is connected to these lower portions the connectors will not be visible from the outer view of the slip. The attach/detach slots will be located at the lower end of the top portion/camisole of the slip to allow other parts of the present invention to connect to this piece The middle/short slip has connectors located at the top end which will allow the top portion/camisole to be attached and detached. Also the middle/short slip has attachable/detachable slots located at the bottom end to allow the adding of additional pieces of the middle/short slip and/or the adding of the bottom/long slip. When the bottom/long slip is attached to the middle/short slip the present invention is lengthen or when detached from the middle/short slip the present invention is shorten. The short half slip can also be worn individually as a separate piece by a rope, cord or string with elastic that can be tied to desired tightness, but are not limited to these methods to provide a secure and comfortable fit.

The bottom/long slip has attachment/detachment zones located at the upper section of the undergarment, that will connect to the bottom section of middle/short slip to make a long half slip. These connections can include buttons, snaps, velcro but are not limited to these methods to accomplish the same or similar results. The long half slip can be worn individually as a separate piece by a rope, cord or string with elastic that can be tied to desired tightness but are not limited to these methods, to provide a secure and comfortable fit.

A principle objective of this invention is to provide a customizable slip design that has multiple pieces that can be attached and detached by connector such as buttons, snaps, velcro, etc. Moreover, when all these pieces are connected the present invention becomes an extended full length slip.

Another objective is that the detachably connected features, slots and zones will allow the user to adjust the slip by shortening or lengthening it according to the dress size, style and/or length, and can interchange the color coordination as desire.

An additional objective is that the slip can be attached/detached at several points horizontally throughout the undergarment and at different levels vertically, to allow the user to adjust or customize the slip further.

Still another objective of this invention is that each piece can be worn separately by means of the straps, a rope, cord or string with elastic that ties to allow the slip to stay securely on the user as a single piece and allow slip to contour to body of user for a comfortable fit.

A further objective is that the attachment/detachment connectors are located in a way not visible from the outside view on the slip. However, inwardly can be adjusted by user within a fold of fabric under a flap of fabric to allow a smooth transition from piece to piece.

Moreover, another objective is to maximize the benefits for females and make the sizes available in children and women in order to provide the same benefits for growing girls.

BRIEF DESCRIPTION OF DRAWINGS

The present invention will be further understood and fully appreciated when considered with the following figures.

DETAILED DESCRIPTION OF PREFERRED EMBODIMENT

Figure 1:
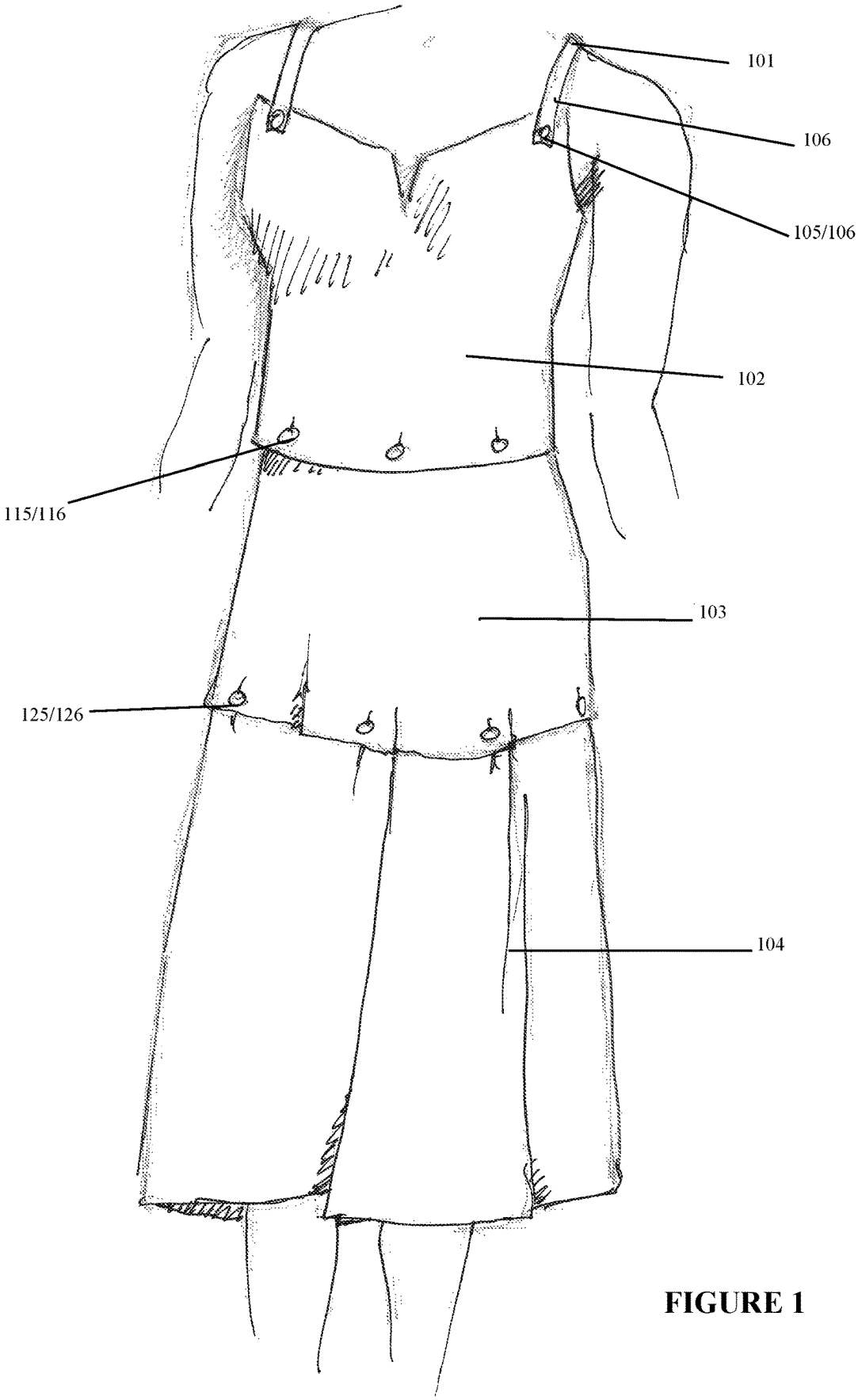
FIG. 1 shows an extended length slip with all parts connected together by attachments/detachment features, zones and slots shown from an outward view.
Figure 2:
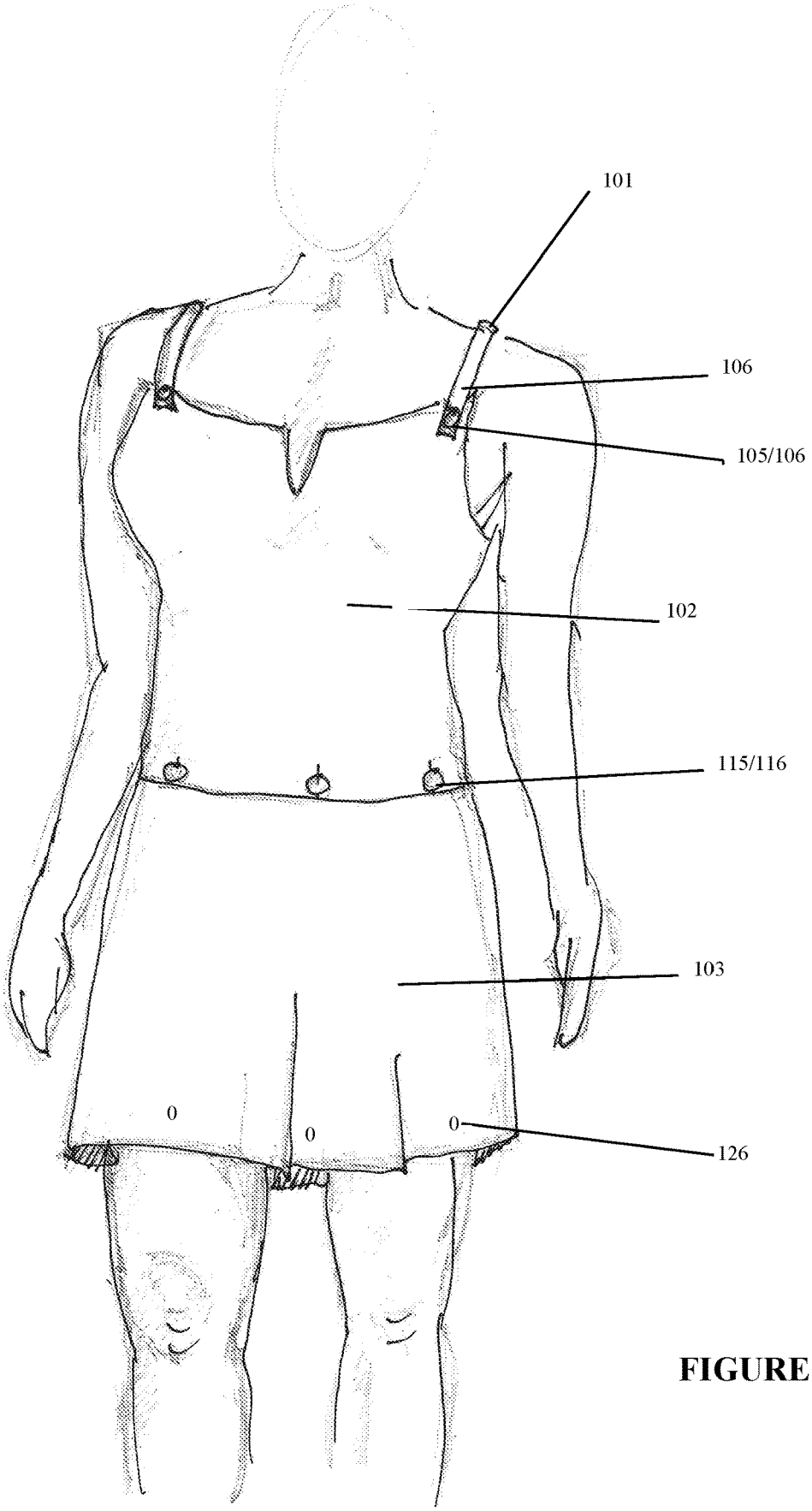
FIG. 2 shows a short length slip version; top portion/camisole with the straps but without lace cleavage cover connected to the middle/short portions.
Figures 5, 5A:
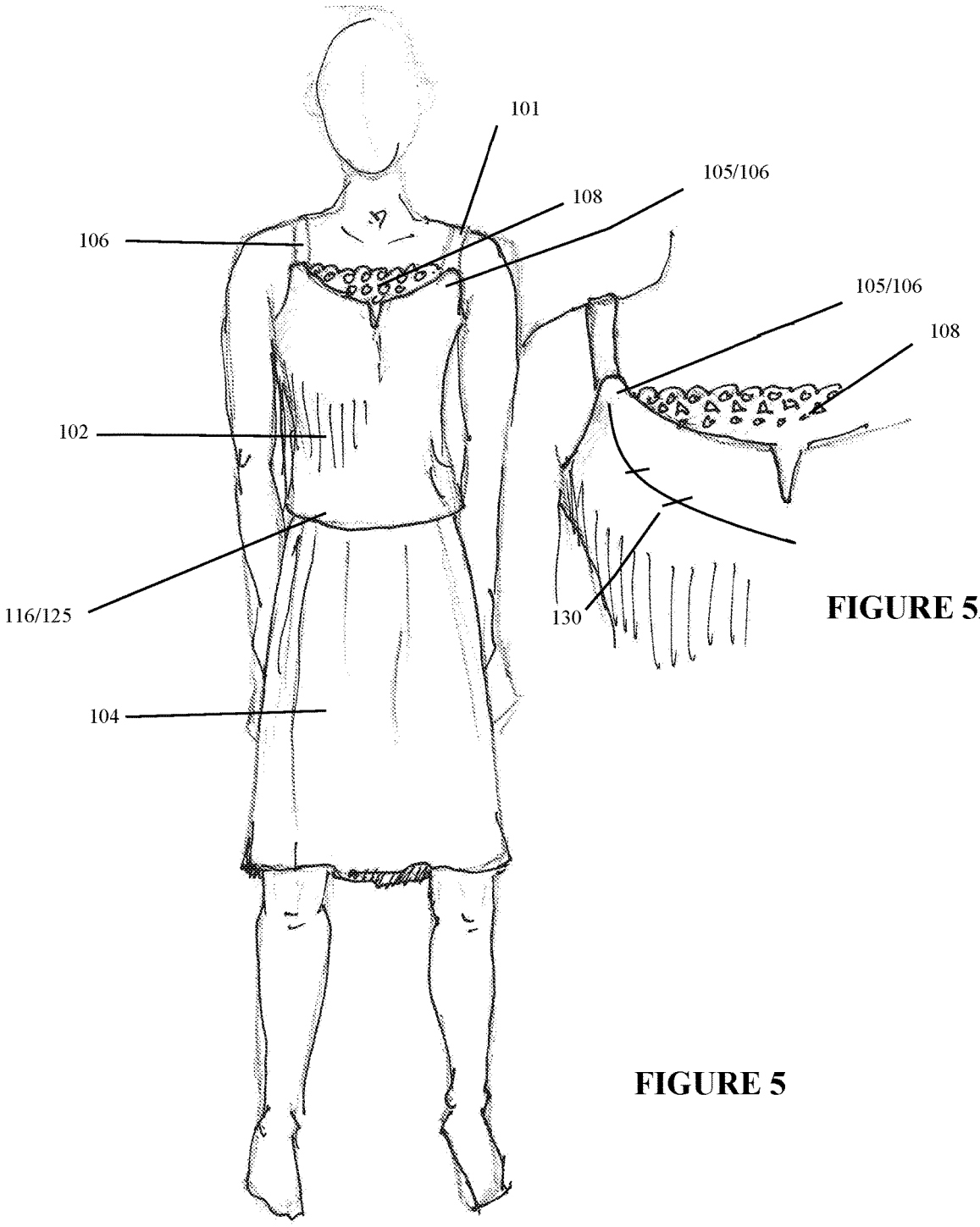
FIG. 5 shows the top portion/camisole with straps and cleavage cover, connected to the bottom/long length slip with a detachably connected feature hidden under fold of top portion/camisole for a smooth transition.
FIG. 5A shows partial lace cleavage cover with rope, cord or string with notches outer view, attached to top portion/camisole.

The present invention comprises of multiple pieces, the straps (101), the top portion/camisole (102), the middle/short slip (103) and the bottom/long slip (104), all shown detachably connected to make a full length slip in Figure (FIG. 1. This invention can be made of various material such as cotton, nylon, polyester, spandex, silk, rayon, lace and/or a combination but are not limited to these. The attach/detach feature located at multiple zones and levels (105/106, 115/116 and 125/126) horizontally and vertically. The attachment/detachment features (105/106, 115/116 and 125/126) will allow the user to interchange the colors to include a multicolors slip such as white and black; white and beige; beige, white and black and/or other colors as desired. The multi-level attachment/detachment slot (106), one on top of the other or vertically located on the straps (101) will allow top portion/camisole (102) to attach/detach from straps (101) this will allow for additional lengthening or shortening of the present invention as shown in FIGS. 1, 2 and 5.

The attachment/detachment feature (105/106) which are shown as buttons in the FIGS. 1-5, can include snaps, velcro and other connections that will accomplish the same or similar results.

Figure 3:
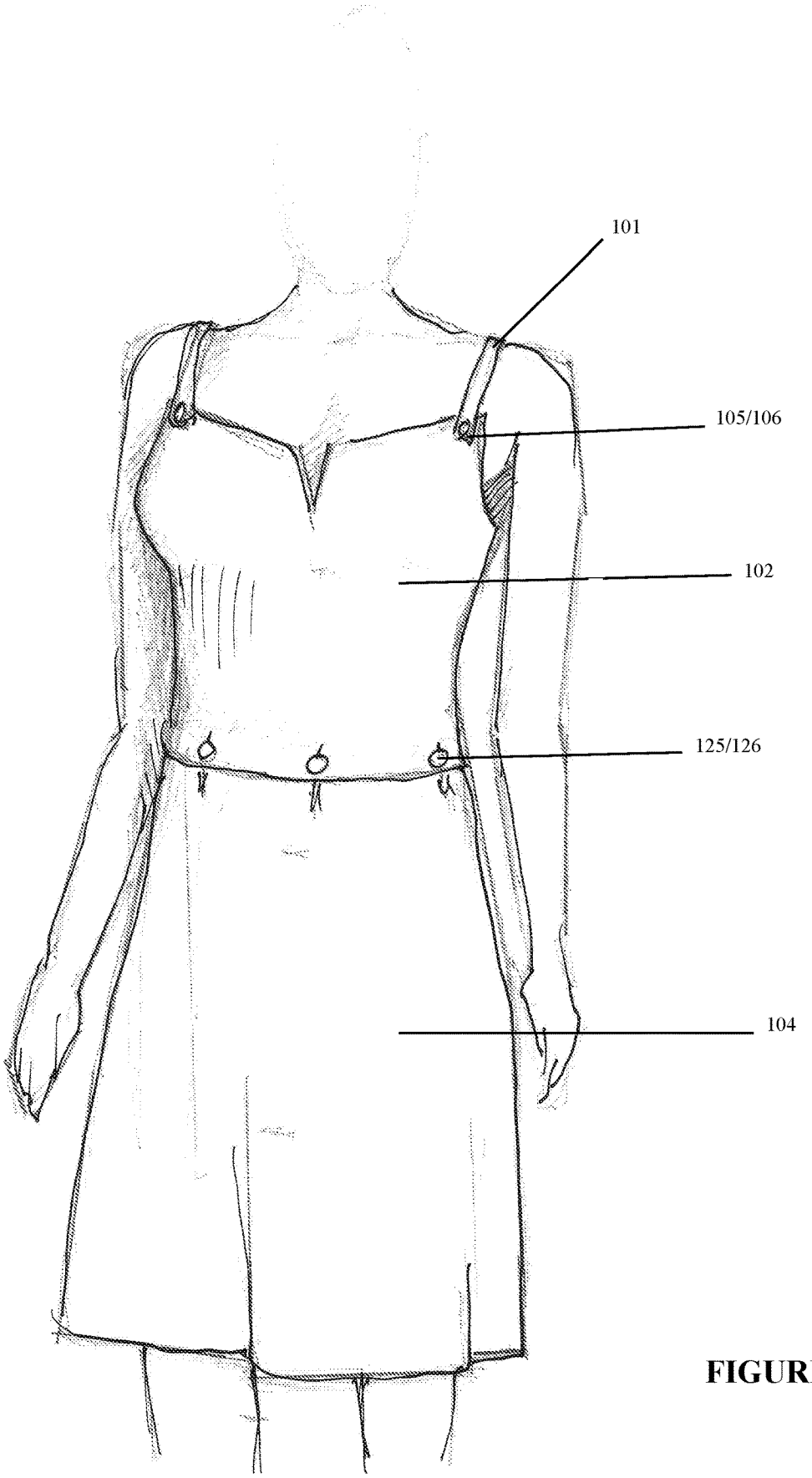
FIG. 3 shows an average length slip version, top portion/camisole with the straps but without lace cleavage cover connected to the bottom/long portion.
Figure 4:
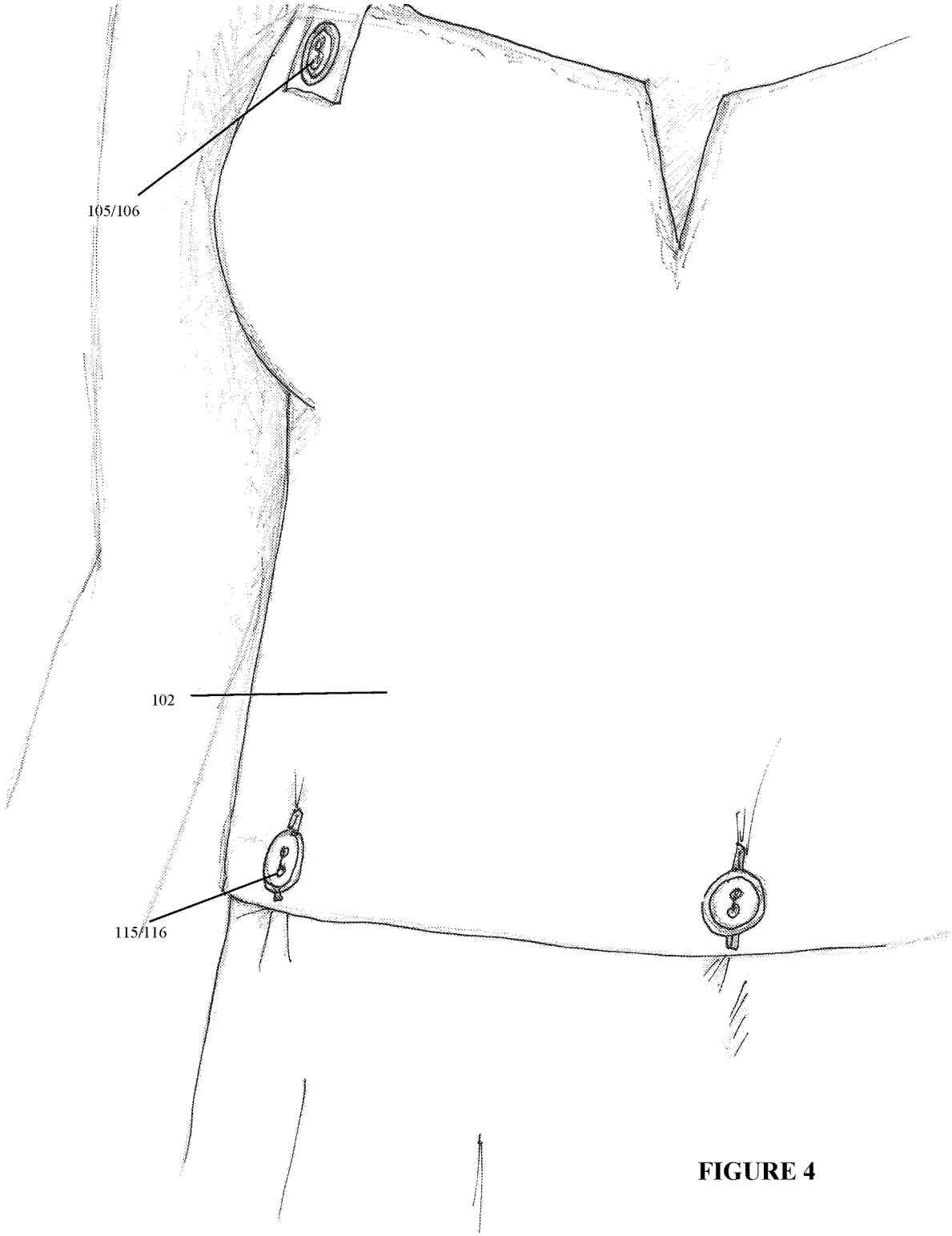
FIG. 4 shows a close up view of one method to detachably connect the top portion of slip by buttons.
Figure 6:
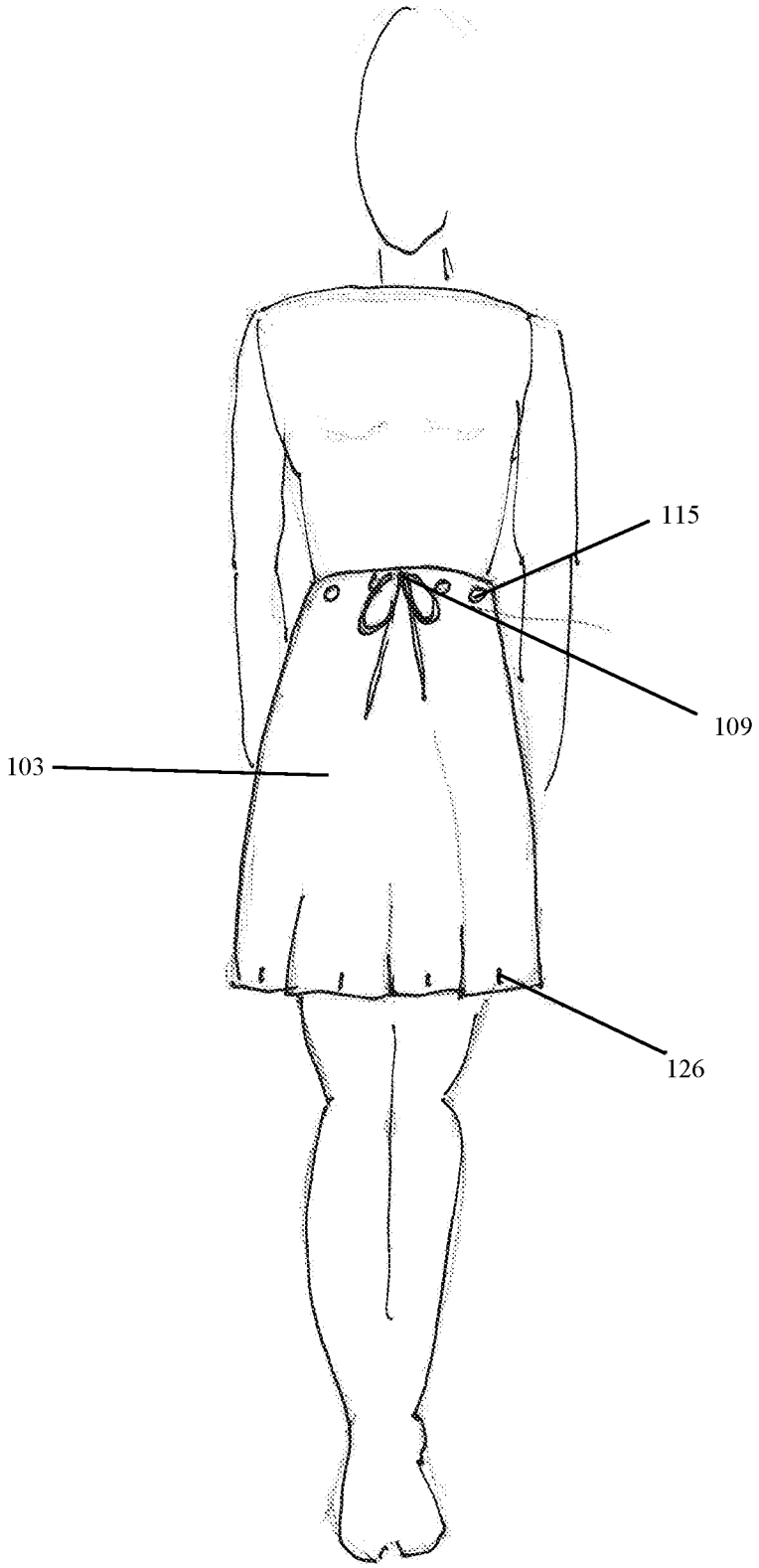
FIG. 6 shows the short length half slip individually worn with rope, cord or string that ties to secure garment with bottom attachment/detachment slots at lower segment.

The slip will be made in all sizes for children and women in order to provide the same benefits for growing girls as adult women. The attachment/detachment features (105/106, 115/116 and 125/126) as shown in FIG. 1 will allow the top portion/camisole (102) to connect by buttons/slots (115/116) to the upper end of the middle/short slip (103) to the attachable/detachable feature (115/116) on the said middle/short slip (103), which then connects by buttons/slots (125/126) to the end of the bottom slip (104) to the attach/detach feature (125/126) as desired. In FIG. 2 the attachments/detachments feature (115/116) located at the top of middle/short slip (103) and the attachment/detachment slot (126) located at the lower end of the middle/short slip (103) will be located in multiple sections horizontally to allow for a secure fastening of slip. FIG. 3 shows the top portion/camisole (102) connected to the bottom/long slip (104) of the present invention that result in an average length slip. The attachment/detachment feature (125/116) is shown at the upper portion of the bottom/long slip (104) in order to connect and disconnect from the top portion/camisole (102) by means of attachment/detachment slots (116/125) as shown in FIG. 3. FIG. 4 shows the top portion/camisole (102) with the attachment/detachments slots (105/106 and 115/116) up close with the buttons attached, however, it is understood that other methods can be applied such as snaps, velcro to produce same or similar results. In FIG. 5 shows the outer view of the average length of the present invention with the top portion/camisole (102), with slots (106) on straps (101), with lace cleavage cover (108) and the bottom/long slip (104) detachably connected (105/106 and 116/125). In FIG. 5A the lace cleavage cover (108) with top portion/camisole (102) is shown partially, the rope, cord or string (130) with notches that will allow lace cleavage cover to adjust to be seen above clothing or folded in order to be lower under clothing and unseen. FIG. 6 shows the middle/short half slip (103) worn individually by a rope, cord or string (109) with elastic that can be tied to desired tightness. The buttons (115) are located at the upper portion of middle/short half slip (103).

Figure 7:
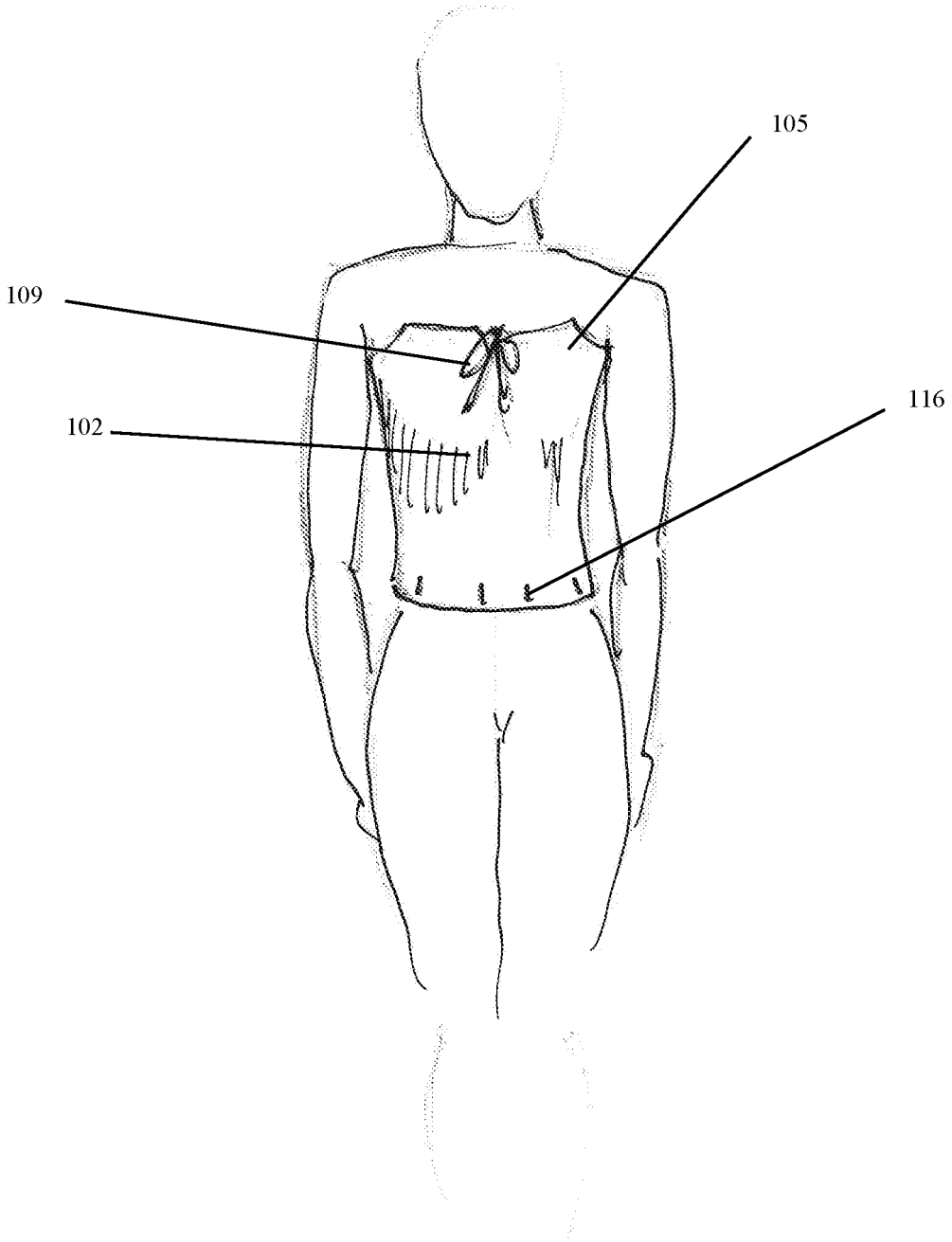
FIG. 7 shows strapless camisole without lace cleavage cover, individually worn with rope, cord or string that ties to secure garment with bottom attachment/detachment slots at lower segment.

At the bottom portion of the middle/short half slip (103) slots (126) this will allow another middle/short half slip (103) to connect by means of the attach/detach feature/slots (115/126) or bottom/long half slip (104). In FIG. 7 the top portion/camisole (102) is shown without the straps (101), with button location (105) and with the draw string, cord or rope (109) that can be tied to secure garment to user, and attach/detach slot (116), however is not limited to these methods. This feature (109) will allow top portion/camisole (102) to be worn separately or individually as desired by user to fit a strapless blouse or dress.

The invention claimed is:

A customizable slip comprising: top portion, middle and bottom slip portions: said top portion comprising straps and an accordion fold cleavage cover; said middle slip portion detachably connected to said top portion and said bottom slip portion detachably connected to said middle slip portion to complete a full length slip;

wherein said top portion is configured to be detachably connected to either said middle slip portion or said bottom slip portion to be worn as separate slips of different lengths; each of said top, middle and bottom portions comprising a rope and elastic member for supporting separate wearing configurations including a strapless top configuration, a long half slip formed by the combined middle and bottom slip portions, and individual middle and bottom slip portions configured as separate slips.

The invention claimed is:

1. A customizable slip comprising:

a top portion, a middle portion, and a bottom portion; said top portion comprising straps; said middle slip portion detachably connected to said top portion and said bottom portion detachably connected to said middle slip portion to complete a full length slip;

wherein said top portion is configured to be detachably connected to either said middle slip portion or said bottom portion to be worn as separate slips of different lengths; each of said top, middle and bottom portions comprising a rope and elastic member for supporting separate wearing configurations including a strapless top configuration, a long half slip formed by the combined middle and bottom portions, and individual middle and bottom portions configured as separate slips.

* * * * *